US010941372B2

(12) United States Patent
Batchelor et al.

(10) Patent No.: US 10,941,372 B2
(45) **Date of Patent: *Mar. 9, 2021**

(54) LAUNDRY DETERGENT COMPOSITION

(71) Applicant: Conopco, Inc., Englewood Cliffs, NJ (US)

(72) Inventors: Stephen Norman Batchelor, Chester (GB); Jayne Michelle Bird, Ellesmere Port (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/578,499

(22) PCT Filed: May 25, 2016

(86) PCT No.: PCT/EP2016/061823

§ 371 (c)(1),
(2) Date: Nov. 30, 2017

(87) PCT Pub. No.: WO2016/198262

PCT Pub. Date: Dec. 15, 2016

(65) Prior Publication Data

US 2018/0100127 A1 Apr. 12, 2018

(30) Foreign Application Priority Data

Jun. 11, 2015 (EP) ..... 15171685

(51) Int. Cl.

| | |
|---|---|
| ***C11D 3/386*** | (2006.01) |
| ***C11D 1/37*** | (2006.01) |
| ***C11D 10/04*** | (2006.01) |
| ***C11D 11/00*** | (2006.01) |
| *C11D 1/06* | (2006.01) |
| *C11D 1/22* | (2006.01) |
| *C11D 1/14* | (2006.01) |
| *C11D 1/29* | (2006.01) |
| *C11D 1/28* | (2006.01) |

(52) U.S. Cl.

CPC ..... *C11D 3/38627* (2013.01); *C11D 1/37* (2013.01); *C11D 3/386* (2013.01); *C11D 10/042* (2013.01); *C11D 11/0017* (2013.01); *C11D 1/06* (2013.01); *C11D 1/146* (2013.01); *C11D 1/22* (2013.01); *C11D 1/28* (2013.01); *C11D 1/29* (2013.01)

(58) Field of Classification Search

CPC ..... C11D 3/386; C11D 1/37

See application file for complete search history.

(56) References Cited

U.S. PATENT DOCUMENTS

| | | | | |
|---|---|---|---|---|
| 6,060,441 | A * | 5/2000 | Hessel | C11D 1/83 510/320 |
| 6,376,445 | B1 | 4/2002 | Bettiol et al. | |
| 6,395,701 | B1 * | 5/2002 | Connor | A61K 8/361 510/437 |
| 6,630,439 | B1 | 10/2003 | Norwood | |
| 6,897,188 | B2 | 5/2005 | Gohl et al. | |
| 7,969,601 | B2 * | 6/2011 | Maeda | H04N 1/0001 358/1.15 |
| 8,586,521 | B2 | 11/2013 | Brooker et al. | |
| 10,676,698 | B2 * | 6/2020 | Batchelor | C11D 3/38627 |
| 2002/0102702 | A1 * | 8/2002 | Osten | C11D 3/386 435/222 |
| 2003/0171249 | A1 * | 9/2003 | Lang | C11D 3/0021 510/528 |
| 2004/0266653 | A1 * | 12/2004 | Delplancke | C11D 3/166 510/470 |
| 2006/0115440 | A1 | 6/2006 | Arata | |
| 2006/0122093 | A1 * | 6/2006 | Permejo | C11D 1/22 510/507 |
| 2012/0151684 | A1 * | 6/2012 | Brooker | C11D 3/3907 8/137 |
| 2013/0123161 | A1 * | 5/2013 | Randall | A61K 8/8194 510/276 |
| 2014/0230156 | A1 | 8/2014 | Lant | |
| 2018/0100127 | A1 * | 4/2018 | Batchelor | C11D 11/0017 |
| 2018/0155657 | A1 * | 6/2018 | Batchelor | C11D 3/38627 |
| 2018/0346845 | A1 * | 12/2018 | Batchelor | C11D 1/37 |

FOREIGN PATENT DOCUMENTS

| | | | |
|---|---|---|---|
| CN | 1276005 | 12/2000 | |
| CN | 1533426 | 9/2004 | |
| CN | 101072859 | 11/2007 | |
| CN | 103975049 | 8/2014 | |
| CN | 103975050 | 8/2014 | |
| DE | 3320340 | 12/1983 | |
| WO | WO9845396 | 10/1998 | |
| WO | WO2013087284 | 6/2013 | |
| WO | WO2013087286 | 6/2013 | |
| WO | WO-2013087286 A1 * | 6/2013 | C11D 1/94 |

(Continued)

OTHER PUBLICATIONS

IPRP2 In PCTEP2016061823, dated Sep. 21, 2017.
IPRP2 in PCTEP2016061831, dated Sep. 29, 2017.
Search Report and Written Opinion in EP15171686, dated Dec. 18, 2015.
Search Report and Written Opinion in PCTEP2016061823, dated Aug. 26, 2016.
Search Report and Written Opinion in PCTEP2016061831, dated Aug. 26, 2016.
Search Report in EP15171685, dated Dec. 10, 2015.
Written Opinion 2 in PCTEP2016061823, dated May 11, 20017.

(Continued)

*Primary Examiner* — Nicole M. Buie-Hatcher
*Assistant Examiner* — M. Reza-Asdjodi
(74) *Attorney, Agent, or Firm* — Greenberg Traurig, LLP

(57) ABSTRACT

The present invention provides a domestic laundry cleaning composition, said composition comprising an anionic charged surfactant, an alkyl ether carboxylic acid dispersant, a lipase enzyme; and a protease enzyme.

11 Claims, No Drawings

(56) References Cited

FOREIGN PATENT DOCUMENTS

| | | | | |
|---|---|---|---|---|
| WO | WO2014060235 | | 4/2014 | |
| WO | WO-2014060235 | A2 * | 4/2014 | ..... C11D 1/83 |
| WO | WO2014130512 | | 8/2014 | |

OTHER PUBLICATIONS

Written Opinion 2 in PCTEP2016061831, dated May 11, 2017.
Written Opinion in EP15171685, dated Dec. 10, 2015.
Co-Pending U.S. Appl. No. 15/578,517; Applicant: Stephen Norman Batchelor, filed: Nov. 30, 2017.

* cited by examiner

LAUNDRY DETERGENT COMPOSITION

FIELD OF INVENTION

The present invention concerns the use of specific alkyl ether carboxylic acids with an enzyme cocktail comprising a lipase and protease enzyme in a detergent formulation.

BACKGROUND OF THE INVENTION

Lipases are used in domestic detergent formulations to remove fat based stains.

Protease enzymes are used in laundry detergent formulations to remove protein containing stains from fabrics.

Many stains found in domestic laundry contain both proteins and fats.

Enzyme cocktails comprising protease and lipases are used in domestic laundry detergent formulations.

There is a need to improve the performance of protease and lipase enzyme cocktails in domestic laundry detergent formulations.

WO2013/087286 (Unilever) discloses liquids formulations containing alkyl ether carboxylic acids, betaines, anionic surfactant, non-ionic surfactant for providing softening benefits.

WO2014/060235 (Unilever) discloses a laundry detergent composition comprising (a) nonionic surfactant, (b) anionic surfactant, (c) alkyl ether carboxylic acid or carboxylate salt thereof, and, (d) a polyglucosamine or a copolymer of glucosamine and N-acetylglucosamine; and to its use to soften fabrics.

US 2006/122093 discloses laundry detergent composition containing from about 1 percent to about 80 percent of a surfactant system, a mixed builder system, and the balance adjunct ingredients. The mixed builder system contains from about 0.1 percent to about 40 percent phosphate builder and from about 0.1 percent to about 40 percent of a non-phosphate builder. During use the concentration of the non-phosphate builder in the wash liquor is from about 240 ppm to about 3,600 ppm and the weight ratio of the phosphate builder to the non-phosphate builder in the wash liquor is from about 1:10 to about 10:1.

US 2002/102702 discloses enzymes produced by mutating the genes for a number of subtilases and expressing the mutated genes in suitable hosts are presented. The enzymes are disclosed as exhibiting improved autoproteolytic stability in comparison to their wild type parent enzymes.

SUMMARY OF THE INVENTION

None of the aforementioned documents disclose a synergy between the combination of a lipase protease enzyme cocktail and specific alkyl ether carboxylic acids.

We have found that the combination of a lipase protease enzyme cocktail and specific alkyl ether carboxylic acid gives enhanced cleaning.

In one aspect the present invention provides a laundry detergent composition comprising:

(i) from 4 to 50 wt % of an anionic charged surfactant, preferably the level of charged surfactant from 6 to 30 wt %, most preferably from 8 to 20 wt %;

(ii) from 0.5 to 20 wt %, preferably from 2 to 14 wt %, most preferably from 2.5 to 5 wt % of an alkyl ether carboxylic acid dispersant of the following structure:

$$R—(OCH_2CH_2)_n—OCH_2—COOH,$$

wherein:

R is selected from saturated and mono-unsaturated C10 to C26 linear or branched alkyl chains, preferably C12 to C24 linear or branched alkyl chains, most preferably a C16 to C20 linear alkyl chain;

n is selected from 5 to 20, preferably 7 to 13, more preferably 8 to 12, most preferably 9.5 to 10.5; and, (iii) from 0.0005 to 0.5 wt % of a lipase enzyme, preferably from 0.01 to 0.2 wt %.

(iv) from 0.0005 to 0.2 wt % of a protease enzyme, preferably from 0.002 to 0.02 wt %.

All enzyme levels refer to pure protein.

In another aspect the present invention provides a domestic method of treating a textile, the method comprising the step of: treating a textile with an aqueous solution of 0.5 to 20 g/L of the laundry detergent composition as defined herein.

DETAILED DESCRIPTION OF THE INVENTION

Alkyl Ether Carboxylic Acid

In the context of the current invention alkyl ether carboxylic acid dispersants are not included as anionic surfactants. Weights of alkyl ether carboxylic acid are calculated as the protonated form, $R—(OCH_2CH_2)_n—OCH_2COOH$. They may be used as salt version for example sodium salt, or amine salt.

The alkyl chain may be linear or branched, preferably it is linear.

The alkyl chain may be aliphatic or contain one cis-double bond. Preferred examples of aliphatic linear chains are $CH_3(CH_2)_{13}$, $CH_3(CH_2)_{15}$, $CH_3(CH_2)_{17}$, and $CH_3(CH_2)_{19}$.

The alkyl chain is most preferably $CH_3(CH_2)_7CH{=}CH(CH_2)_8$.

The alkyl ether carboxylic acid is most preferably of the structure:

$$CH_3(CH_2)_7CH{=}CH(CH_2)_8(OCH_2CH_2)_{10}OCH_2COOH.$$

Alkyl ether carboxylic acid are available from Kao (Akypo®), Sassol (Marlowet®) Huntsman (Empicol®) and Clariant (Emulsogen®).

Lipases

Cleaning lipases are discussed in Enzymes in Detergency edited by Jan H. Van Ee, Onno Misset and Erik J. Baas (1997 Marcel Dekker, New York).

Cleaning lipases are preferable active at alkaline pH in the range 7 to 11, most preferably they have maximum activity in the pH range 8 to 10.5.

The lipase may be selected from lipase enzymes in E.C. class 3.1 or 3.2 or a combination thereof.

Preferably the cleaning lipases selected a Triacylglycerol lipases (E.C. 3.1.1.3).

Suitable triacylglycerol lipases can be selected from variants of the *Humicola lanuginosa* (*Thermomyces lanuginosus*) lipase. Other suitable triacylglycerol lipases can be selected from variants of *Pseudomonas* lipases, e.g., from *P. alcaligenes* or *P. pseudoalcaligenes* (EP 218 272), *P. cepacia* (EP 331 376), *P. stutzeri* (GB 1,372,034), *P. fluorescens, Pseudomonas* sp. strain SD 705 (WO 95/06720 and WO 96/27002), *P. wisconsinensis* (WO 96/12012), *Bacillus lipases*, e.g., from *B. subtilis* (Dartois et al. (1993), Biochemica et Biophysica Acta, 1131, 253-360), *B. stearothermophilus* (JP 64/744992) or *B. pumilus* (WO 91/16422).

Further examples of EC 3.1.1.3 lipases include those described in WIPO publications WO 00/60063, WO 99/42566, WO 02/062973, WO 97/04078, WO 97/04079 and U.S. Pat. No. 5,869,438. Preferred lipases are produced by *Absidia reflexa, Absidia corymbefera, Rhizmucor miehei, Rhizopus deleman Aspergillus niger, Aspergillus tubigensis, Fusarium oxysporum, Fusarium heterosporum, Aspergillus oryzea, Penicilium camembertii, Aspergillus foetidus, Aspergillus niger, Thermomyces lanoginosus* (synonym: *Humicola lanuginosa*) and Landerina penisapora, particularly *Thermomyces lanoginosus*. Certain preferred lipases are supplied by Novozymes under the tradenames. Lipolase®, Lipolase Ultra®, Lipoprime®, Lipoclean® and Lipex® (registered tradenames of Novozymes) and LIPASE P "AMANO®" available from Areario Pharmaceutical Co. Ltd., Nagoya, Japan, AMANO-CES®, commercially available from Toyo Jozo Co., Tagata, Japan; and further Chromobacter viscosum lipases from Amersham Pharmacia Biotech., Piscataway, N.J., U.S.A. and Diosynth Co., Netherlands, and other lipases such as *Pseudomonas gladioli*. Additional useful lipases are described in WIPO publications WO 02062973, WO 2004/101759, WO 2004/101760 and WO 2004/101763. In one embodiment, suitable lipases include the "first cycle lipases" described in WO 00/60063 and U.S. Pat. No. 6,939,702 BI, preferably a variant of SEQ ID No. 2, more preferably a variant of SEQ ID No. 2 having at least 90% homology to SEQ ID No. 2 comprising a substitution of an electrically neutral or negatively charged amino acid with R or K at any of positions 3, 224, 229, 231 and 233, with a most preferred variant comprising T23 IR and N233R mutations, such most preferred variant being sold under the tradename Lipex® (Novozymes).

The aforementioned lipases can be used in combination (any mixture of lipases can be used). Suitable lipases can be purchased from Novozymes, Bagsvaerd, Denmark; Areario Pharmaceutical Co. Ltd., Nagoya, Japan; Toyo Jozo Co., Tagata, Japan; Amersham Pharmacia Biotech., Piscataway, N.J., U.S.A; Diosynth Co., Oss, Netherlands and/or made in accordance with the examples contained herein.

Lipase with reduced potential for odour generation and a good relative performance, are particularly preferred, as described in WO2007/087243. These include Lipoclean® (Novozyme).

Protease

Protease enzymes hydrolyse bonds within peptides and proteins, in the laundry context this leads to enhanced removal of protein or peptide containing stains. Examples of suitable proteases families include aspartic proteases; cysteine proteases; glutamic proteases; aspargine peptide lyase; serine proteases and threonine proteases. Such protease families are described in the MEROPS peptidase database (http://merops.sanger.ac.uk/). Serine proteases are preferred. Subtilase type serine proteases are more preferred. The term "subtilases" refers to a sub-group of serine protease according to Siezen et al., Protein Engng. 4 (1991) 719-737 and Siezen et al. Protein Science 6 (1997) 501-523. Serine proteases are a subgroup of proteases characterized by having a serine in the active site, which forms a covalent adduct with the substrate. The subtilases may be divided into 6 sub-divisions, i.e. the Subtilisin family, the Thermitase family, the Proteinase K family, the Lantibiotic peptidase family, the Kexin family and the Pyrolysin family.

Examples of subtilases are those derived from *Bacillus* such as *Bacillus lentus, B. alkalophilus, B. subtilis, B. amyloliquefaciens, Bacillus pumilus* and *Bacillus gibsonii* described in; U.S. Pat. No. 7,262,042 and WO09/021867, and subtilisin lentus, subtilisin Novo, subtilisin Carlsberg, *Bacillus licheniformis*, subtilisin BPN', subtilisin 309, subtilisin 147 and subtilisin 168 described in WO89/06279 and protease PD138 described in (WO93/18140). Other useful proteases may be those described in WO92/175177, WO01/016285, WO02/026024 and WO02/016547. Examples of trypsin-like proteases are trypsin (e.g. of porcine or bovine origin) and the Fusarium protease described in WO89/06270, W094/25583 and WO05/040372, and the chymotrypsin proteases derived from Cellumonas described in WO05/052161 and WO05/052146.

Further Examples of useful proteases are the variants described in: W092/19729, WO96/034946, WO98/201 15, WO98/201 16, WO99/01 1768, WO01/44452, WO03/006602, WO04/03186, WO04/041979, WO07/006305, W01 1/036263, W01 1/036264, especially the variants with substitutions in one or more of the following positions: 3, 4, 9, 15, 27, 36, 57, 68, 76, 87, 95, 96, 97, 98, 99, 100, 101, 102, 103, 104, 106, 1 18, 120, 123, 128, 129, 130, 160, 167, 170, 194, 195, 199, 205, 206, 217, 218, 222, 224, 232, 235, 236, 245, 248, 252 and 274 using the BPN' numbering. More preferred the subtilase variants may comprise the mutations: S3T, V4I, S9R, A15T, K27R, *36D, V68A, N76D, N87S, R, *97E, A98S, S99G, D, A, S99AD, S101 G, M, R S103A, V104I, Y, N, S106A, G1 18V, R, H120D, N, N123S, S128L, P129Q, S130A, G160D, Y167A, R170S, A194P, G195E, V199M, V205I, L217D, N218D, M222S, A232V, K235L, Q236H, Q245R, N252K, T274A (using BPN' numbering).

Most preferably the protease is a subtilisins (EC 3.4.21.62).

Examples of subtilases are those derived from *Bacillus* such as *Bacillus lentus, B. alkalophilus, B. subtilis, B. amyloliquefaciens, Bacillus pumilus* and *Bacillus gibsonii* described in; U.S. Pat. No. 7,262,042 and WO09/021867, and subtilisin lentus, subtilisin Novo, subtilisin Carlsberg, *Bacillus licheniformis*, subtilisin BPN', subtilisin 309, subtilisin 147 and subtilisin 168 described in WO89/06279 and protease PD138 described in (WO93/18140). Preferably the subsilisin is derived from *Bacillus*, preferably *Bacillus lentus, B. alkalophilus, B. subtilis, B. amyloliquefaciens, Bacillus pumilus* and *Bacillus gibsonii* as described in U.S. Pat. Nos. 6,312,936 B I, 5,679,630, 4,760,025, 7,262,042 and WO09/021867. Most preferably the subtilisin is derived from *Bacillus gibsonii* or *Bacillus Lentus*.

Suitable commercially available protease enzymes include those sold under the trade names names Alcalase®, Blaze®; Duralase™, Durazym™, Relase®, Relase® Ultra, Savinase®, Savinase® Ultra, Primase®, Polarzyme®, Kannase®, Liquanase®, Liquanase® Ultra, Ovozyme®, Coronase®, Coronase® Ultra, Neutrase®, Everlase® and Esperase® all could be sold as Ultra® or Evity® (Novozymes A/S).

Those sold under the tradename Maxatase®, Maxacal®, Maxapem®, Properase®, Purafect®, Purafect Prime®, Purafect Ox®, FN3®, FN4®, Excellase® and Purafect OXP® by Genencor International.

Those sold under the tradename Maxatase®, Maxacal®, Maxapem®, Purafect®, Purafect Prime®, Preferenz™, Purafect MA®, Purafect Ox®, Purafect OxP®, Puramax®, Properase®, Effectenz™, FN2®, FN3®, FN4®, Excellase®, Opticlean® and Optimase® (Danisco/DuPont), Axapem™ (Gist-Brocases N.V.).

Those available from Henkel/Kemira, namely BLAP (sequence shown in FIG. 29 of U.S. Pat. No. 5,352,604 with the following mutations S99D+SIOI R+S103A+V104I+G159S, hereinafter referred to as BLAP), BLAP R (BLAP with S3T+V4I+V199M+V205I+L217D), BLAP X (BLAP with S3T+V4I+V205I) and BLAP F49 (BLAP with S3T+V4I+A194P+V199M+V205I+L217D)—all from Henkel/Kemira; and KAP (*Bacillus alkalophilus* subtilisin with mutations A230V+S256G+S259N) from Kao.

Metalloproteases, most preferably zinc based proteases, may also be used.

Surfactant

The laundry composition comprises anionic charged surfactant (which includes a mixture of the same). The composition comprises from 4 to 50 wt % of an anionic surfactant, preferably from 6 to 30 wt %, more preferably from 8 to 20 wt %.

The formulation may contain non-ionic surfactant, preferably the weight fraction of non-ionic surfactant/anionic surfactant is from 0 to 0.3, preferably 0 to 0.1.

Suitable anionic detergent compounds which may be used are usually water-soluble alkali metal salts of organic sulphates and sulphonates having alkyl radicals containing from about 8 to about 22 carbon atoms, the term alkyl being used to include the alkyl portion of higher alkyl radicals.

Examples of suitable synthetic anionic detergent compounds are sodium and potassium alkyl sulphates, especially those obtained by sulphating higher $C_8$ to $C_{18}$ alcohols, produced for example from tallow or coconut oil, sodium and potassium alkyl $C_9$ to $C_{20}$ benzene sulphonates, particularly sodium linear secondary alkyl $C_{10}$ to $C_{15}$ benzene sulphonates; and sodium alkyl glyceryl ether sulphates, especially those ethers of the higher alcohols derived from tallow or coconut oil and synthetic alcohols derived from petroleum.

The anionic surfactant is preferably selected from: linear alkyl benzene sulphonate; alkyl sulphates; alkyl ether sulphates; soaps; alkyl (preferably methyl) ester sulphonates, and mixtures thereof.

The most preferred anionic surfactants are selected from: linear alkyl benzene sulphonate; alkyl sulphates; alkyl ether sulphates and mixtures thereof. Preferably the alkyl ether sulphate is a $C_{12}$-$C_{14}$ n-alkyl ether sulphate with an average of 1 to 3EO (ethoxylate) units. Sodium lauryl ether sulphate is particularly preferred (SLES). Preferably the linear alkyl benzene sulphonate is a sodium $C_{11}$ to $C_{15}$ alkyl benzene sulphonates. Preferably the alkyl sulphates is a linear or branched sodium $C_{12}$ to $C_{18}$ alkyl sulphates. Sodium dodecyl sulphate is particularly preferred, (SDS, also known as primary alkyl sulphate).

In liquid formulations preferably two or more anionic surfactant are present, for example linear alkyl benzene sulphonate together with an alkyl ether sulphate.

In liquid formulations, preferably the laundry composition in addition to the anionic surfactant comprises alkyl exthoylated non-ionic surfactant, preferably from 2 to 8 wt % of alkyl ethoxylated non-ionic surfactant.

Suitable nonionic detergent compounds which may be used include, in particular, the reaction products of compounds having an aliphatic hydrophobic group and a reactive hydrogen atom, for example, aliphatic alcohols, acids or amides, especially ethylene oxide either alone or with propylene oxide. Preferred nonionic detergent compounds are the condensation products of aliphatic $C_8$ to $C_{18}$ primary or secondary linear or branched alcohols with ethylene oxide.

Most preferably the nonionic detergent compound is the alkyl ethoxylated non-ionic surfactant is a $C_8$ to $C_{18}$ primary alcohol with an average ethoxylation of 7EO to 9EO units.

Preferably the surfactants used are saturated.

Builders or Complexing Agents

Builder materials may be selected from 1) calcium sequestrant materials, 2) precipitating materials, 3) calcium ion-exchange materials and 4) mixtures thereof.

Examples of calcium sequestrant builder materials include alkali metal polyphosphates, such as sodium tripolyphosphate and organic sequestrants, such as ethylene diamine tetra-acetic acid.

Examples of precipitating builder materials include sodium orthophosphate and sodium carbonate.

Examples of calcium ion-exchange builder materials include the various types of water-insoluble crystalline or amorphous aluminosilicates, of which zeolites are well known representatives thereof, e.g. zeolite A, zeolite B (also known as zeolite P), zeolite C, zeolite X, zeolite Y and also the zeolite P-type as described in EP-A-0,384,070.

The composition may also contain 0-65% of a builder or complexing agent such as ethylenediaminetetraacetic acid, diethylenetriamine-pentaacetic acid, alkyl- or alkenylsuccinic acid, nitrilotriacetic acid or the other builders mentioned below. Many builders are also bleach-stabilising agents by virtue of their ability to complex metal ions.

Zeolite and carbonate (carbonate (including bicarbonate and sesquicarbonate) are preferred builders, with carbonates being particularly preferred.

The composition may contain as builder a crystalline aluminosilicate, preferably an alkali metal aluminosilicate, more preferably a sodium aluminosilicate. This is typically present at a level of less than 15 wt %. Aluminosilicates are materials having the general formula:

$$0.8\text{-}1.5\ M_2O.Al_2O_3.0.8\text{-}6SiO_2,$$

where M is a monovalent cation, preferably sodium. These materials contain some bound water and are required to have a calcium ion exchange capacity of at least 50 mg CaO/g. The preferred sodium aluminosilicates contain 1.5-3.5 $SiO_2$ units in the formula above. They can be prepared readily by reaction between sodium silicate and sodium aluminate, as amply described in the literature. The ratio of surfactants to alumuminosilicate (where present) is preferably greater than 5:2, more preferably greater than 3:1.

Alternatively, or additionally to the aluminosilicate builders, phosphate builders may be used. In this art the term 'phosphate' embraces diphosphate, triphosphate, and phosphonate species. Other forms of builder include silicates, such as soluble silicates, metasilicates, layered silicates (e.g. SKS-6 from Hoechst).

Most preferably the laundry detergent formulation is a non-phosphate built powder laundry detergent formulation, i.e., contains less than 1 wt % of phosphate. Preferably the powder laundry detergent formulations are predominantly carbonate built. Powders, should preferably give an in use pH of from 9.5 to 11. Preferably the powder laundry detergent has linear alkyl benzene sulfonate as greater than 80 wt % of the total anionic surfactant present.

In the aqueous liquid laundry detergent it is preferred that mono propylene glycol is present at a level from 1 to 30 wt %, most preferably 2 to 18 wt %, to provide the formulation with appropriate, pourable viscosity.

Fluorescent Agent

The composition preferably comprises a fluorescent agent (optical brightener). Fluorescent agents are well known and many such fluorescent agents are available commercially.

Usually, these fluorescent agents are supplied and used in the form of their alkali metal salts, for example, the sodium salts.

The total amount of the fluorescent agent or agents used in the composition is generally from 0.0001 to 0.5 wt %, preferably 0.005 to 2 wt %, more preferably 0.01 to 0.1 wt %.

Preferred classes of fluorescer are: Di-styryl biphenyl compounds, e.g. Tinopal (Trade Mark) CBS-X, Di-amine stilbene di-sulphonic acid compounds, e.g. Tinopal DMS pure Xtra and Blankophor (Trade Mark) HRH, and Pyrazoline compounds, e.g. Blankophor SN.

Preferred fluorescers are fluorescers with CAS-No 3426-43-5; CAS-No 35632-99-6; CAS-No 24565-13-7; CAS-No 12224-16-7; CAS-No 13863-31-5; CAS-No 4193-55-9; CAS-No 16090-02-1; CAS-No 133-66-4; CAS-No 68444-86-0; CAS-No 27344-41-8.

Most preferred fluorescers are: sodium 2 (4-styryl-3-sulfophenyl)-2H-napthol[1,2-d]triazole, disodium 4,4'-bis{[(4-anilino-6-(N methyl-N-2 hydroxyethyl) amino 1,3,5-triazin-2-yl)]amino}stilbene-2-2' disulphonate, disodium 4,4'-bis{[(4-anilino-6-morpholino-1,3,5-triazin-2-yl)] amino} stilbene-2-2' disulphonate, and disodium 4,4'-bis(2-sulphostyryl)biphenyl.

The aqueous solution used in the method has a fluorescer present. The fluorescer is present in the aqueous solution used in the method preferably in the range from 0.0001 g/l to 0.1 g/l, more preferably 0.001 to 0.02 g/l.

Perfume

The composition preferably comprises a perfume. Many suitable examples of perfumes are provided in the CTFA (Cosmetic, Toiletry and Fragrance Association) 1992 International Buyers Guide, published by CFTA Publications and OPD 1993 Chemicals Buyers Directory 80th Annual Edition, published by Schnell Publishing Co.

Preferably the perfume comprises at least one note (compound) from: alpha-isomethyl ionone, benzyl salicylate; citronellol; coumarin; hexyl cinnamal; linalool; pentanoic acid, 2-methyl-, ethyl ester; octanal; benzyl acetate; 1,6-octadien-3-ol, 3,7-dimethyl-, 3-acetate; cyclohexanol, 2-(1,1-dimethylethyl)-, 1-acetate; delta-damascone; beta-ionone; verdyl acetate; dodecanal; hexyl cinnamic aldehyde; cyclopentadecanolide; benzeneacetic acid, 2-phenylethyl ester; amyl salicylate; beta-caryophyllene; ethyl undecylenate; geranyl anthranilate; alpha-irone; beta-phenyl ethyl benzoate; alpa-santalol; cedrol; cedryl acetate; cedry formate; cyclohexyl salicyate; gamma-dodecalactone; and, beta phenylethyl phenyl acetate.

Useful components of the perfume include materials of both natural and synthetic origin. They include single compounds and mixtures. Specific examples of such components may be found in the current literature, e.g., in Fenaroli's Handbook of Flavour Ingredients, 1975, CRC Press; Synthetic Food Adjuncts, 1947 by M. B. Jacobs, edited by Van Nostrand; or Perfume and Flavour Chemicals by S. Arctander 1969, Montclair, N.J. (USA).

It is commonplace for a plurality of perfume components to be present in a formulation. In the compositions of the present invention it is envisaged that there will be four or more, preferably five or more, more preferably six or more or even seven or more different perfume components.

In perfume mixtures preferably 15 to 25 wt % are top notes. Top notes are defined by Poucher (Journal of the Society of Cosmetic Chemists 6(2):80 [1955]). Preferred top-notes are selected from citrus oils, linalool, linalyl acetate, lavender, dihydromyrcenol, rose oxide and cis-3-hexanol.

The International Fragrance Association has published a list of fragrance ingredients (perfumes) in 2011. (http://www.ifraorg.org/en-us/ingredients#.U7Z4hPldWzk)

The Research Institute for Fragrance Materials provides a database of perfumes (fragrances) with safety information.

Perfume top note may be used to cue the whiteness and brightness benefit of the invention.

Some or all of the perfume may be encapsulated, typical perfume components which it is advantageous to encapsulate, include those with a relatively low boiling point, preferably those with a boiling point of less than 300, preferably 100-250 Celsius. It is also advantageous to encapsulate perfume components which have a low C Log P (ie. those which will have a greater tendency to be partitioned into water), preferably with a C Log P of less than 3.0. These materials, of relatively low boiling point and relatively low C Log P have been called the "delayed blooming" perfume ingredients and include one or more of the following materials: allyl caproate, amyl acetate, amyl propionate, anisic aldehyde, anisole, benzaldehyde, benzyl acetate, benzyl acetone, benzyl alcohol, benzyl formate, benzyl iso valerate, benzyl propionate, beta gamma hexenol, camphor gum, laevo-carvone, d-carvone, cinnamic alcohol, cinamyl formate, cis-jasmone, cis-3-hexenyl acetate, cuminic alcohol, cyclel c, dimethyl benzyl carbinol, dimethyl benzyl carbinol acetate, ethyl acetate, ethyl aceto acetate, ethyl amyl ketone, ethyl benzoate, ethyl butyrate, ethyl hexyl ketone, ethyl phenyl acetate, eucalyptol, eugenol, fenchyl acetate, flor acetate (tricyclo decenyl acetate), frutene (tricycico decenyl propionate), geraniol, hexenol, hexenyl acetate, hexyl acetate, hexyl formate, hydratropic alcohol, hydroxycitronellal, indone, isoamyl alcohol, iso menthone, isopulegyl acetate, isoquinolone, ligustral, linalool, linalool oxide, linalyl formate, menthone, menthyl acetphenone, methyl amyl ketone, methyl anthranilate, methyl benzoate, methyl benyl acetate, methyl eugenol, methyl heptenone, methyl heptine carbonate, methyl heptyl ketone, methyl hexyl ketone, methyl phenyl carbinyl acetate, methyl salicylate, methyl-n-methyl anthranilate, nerol, octalactone, octyl alcohol, p-cresol, p-cresol methyl ether, p-methoxy acetophenone, p-methyl acetophenone, phenoxy ethanol, phenyl acetaldehyde, phenyl ethyl acetate, phenyl ethyl alcohol, phenyl ethyl dimethyl carbinol, prenyl acetate, propyl bornate, pulegone, rose oxide, safrole, 4-terpinenol, alpha-terpinenol, and/or viridine. It is commonplace for a plurality of perfume components to be present in a formulation. In the compositions of the present invention it is envisaged that there will be four or more, preferably five or more, more preferably six or more or even seven or more different perfume components from the list given of delayed blooming perfumes given above present in the perfume.

Another group of perfumes with which the present invention can be applied are the so-called 'aromatherapy' materials. These include many components also used in perfumery, including components of essential oils such as Clary Sage, Eucalyptus, Geranium, Lavender, Mace Extract, Neroli, Nutmeg, Spearmint, Sweet Violet Leaf and Valerian.

It is preferred that the laundry treatment composition does not contain a peroxygen bleach, e.g., sodium percarbonate, sodium perborate, and peracid.

Polymers

The composition may comprise one or more further polymers. Examples are carboxymethylcellulose, poly (ethylene glycol), poly(vinyl alcohol), polycarboxylates such as polyacrylates, maleic/acrylic acid copolymers and lauryl methacrylate/acrylic acid copolymers.

Where alkyl groups are sufficiently long to form branched or cyclic chains, the alkyl groups encompass branched, cyclic and linear alkyl chains. The alkyl groups are preferably linear or branched, most preferably linear.

The indefinite article "a" or "an" and its corresponding definite article "the" as used herein means at least one, or one or more, unless specified otherwise.

Dye weights refer to the sodium or chloride salts unless otherwise stated.

EXPERIMENTAL EXAMPLES

A powder laundry detergent was prepared of the following formulation:

| Ingredient | Weight % |
|---|---|
| Linear alkyl benzene sulfonate | 14.5 |
| Sodium carbonate | 20.0 |
| Sodium sulphate | 50.0 |
| Sodium silicate | 6.0 |
| zeolite | 2.5 |
| Salt speckle granules (blue and red) | 1.8 |
| perfume | 0.3 |
| Sodium carboxymethylcellulose | 0.1 |
| Sokalan CP5 (ex BASF) | 0.1 |
| Minors (including fluorescer shading dye with CAS-No 72749-80-5 and CAS-No 81-42-5) and moisture | to 100% |

The formulation was used to wash eight 5×5 cm EMPA 117 stain monitor (blood/milk/ink stain on polycotton) in a tergotometer set at 200 rpm. A 60 minute wash was conducted in 800 ml of 26° French Hard water at 35° C., with 1.5 g/L of the formulation. To simulate oily soil (7.4 g) of an SBL2004 soil strip (ex Warwick Equest) was added to the wash liquor.

Once the wash had been completed the cotton monitors were rinsed once in 400 ml clean water, removed dried and the colour measured on a reflectometer and expressed as the CIE L*a*b* values.

Stain removal was calculates as the ΔL* value:

$$\Delta L^* = L^*(\text{treatment}) - L^*(\text{control without enzyme or alkyl ether carboxylic acid})$$

Higher ΔL* value equate to better cleaning.

Equivalent Formulations but with the addition of 13.3 wt % alkyl ether carboxylic acid, wherein the alkyl group was cis-9-octadecene, were tested. The average number of ethoxy groups was 10.

Experiments were repeated with and without the addition of a lipase-protease enzyme cocktail: Lipex® as the lipase and Savanase® as the protease (both ex Novozymes). The lipase was added to give 0.3 wt % pure active protein to the formulation and the protease was added to give 0.007 wt % pure active protein to the formulation.

95% confidence limits are also given calculated from the standard deviation on the measurements from the 8 monitors.

| | Without enzyme cocktail Reference | | With enzyme cocktail | |
|---|---|---|---|---|
| | ΔL* | 95% | ΔL* | 95% |
| Reference | 0.0 | — | 5.5 | 0.4 |
| Without dispersant | | | | |
| With alkyl ether carboxylic acid | 2.1 | 0.5 | 11.1 | 0.5 |

The combination of the enzyme cocktail and alkyl ether carboxylic acid than expected from combination of the effects of the single components. For the combination a ΔL*=5.5+2.2=7.7 would be expected but 11.1 obtained.

The formulation was remade with the addition of mix of amylase, mannase and pectinase enzymes (Stainzyme® Novozyme, Mannaway® Novozymes, Pectawash® Novozymes).

The invention claimed is:

1. A laundry detergent composition comprising:

(i) from 4 to 50 wt % of an anionic charged surfactant, other than an alkyl ether carboxylic acid dispersant;

(ii) from 0.5 to 20 wt % of an alkyl ether carboxylic acid dispersant of the following structure:

$$R—(OCH_2CH_2)_n—OCH_2—COOH,$$

wherein:

n is selected from 7 to 13;

wherein the R is cis-9-octadecene, (iii) from 0.0005 to 0.5 wt % of a lipase enzyme; and, (iv) from 0.0005 to 0.2 wt % of a protease enzyme.

2. A laundry detergent composition according to claim 1 wherein the lipase is selected from a triacylglycerol lipase E.C. 3.1.1.3.

3. A laundry detergent composition according to claim 1 where the protease is a subtilisins type serine proteases EC 3.4.21.62.

4. A laundry detergent composition according to claim 1, wherein the n is selected from 8 to 12.

5. A laundry detergent composition according to claim 1, wherein the alkyl ether carboxylic acid dispersant is:

$$CH_3(CH_2)_7CH{=}CH(CH_2)_8(OCH_2CH_2)_{10}OCH_2COOH.$$

6. A laundry detergent composition according to claim 1, where in the composition is a non-phosphate built powder laundry detergent formulation.

7. A laundry detergent composition according to claim 1, wherein the lipase is present at a level of from 0.01 to 0.2 wt % and the protease is present at a level from 0.002 to 0.02 wt %.

8. A laundry detergent composition according to claim 1, wherein the anionic charged surfactant is selected from: linear alkyl benzene sulphonate; alkyl sulphates; alkyl ether sulphates; soaps; methyl ester sulphonates; and mixtures thereof.

9. A laundry detergent composition according to claim 1, wherein the anionic charged surfactant is selected from: linear alkyl benzene sulphonate; alkyl sulphates; alkyl ether sulphates; and mixtures thereof.

10. A laundry detergent composition according to claim 1 wherein the level of anionic surfactant is from 8 to 20 wt %.

11. A domestic method of treating a textile, the method comprising the step of: treating a textile with an aqueous solution of 0.5 to 20 g/L of the laundry detergent composition according to claim 1.

* * * * *